US011473219B2

(12) United States Patent
Irisawa et al.

(10) Patent No.: US 11,473,219 B2
(45) Date of Patent: Oct. 18, 2022

(54) METHOD FOR PRODUCING A POLYBENZIMIDAZOLE CARBON FIBER

(71) Applicant: NATIONAL INSTITUTE OF ADVANCED INDUSTRIAL SCIENCE AND TECHNOLOGY, Tokyo (JP)

(72) Inventors: Toshihira Irisawa, Ibaraki (JP); Hiroaki Hatori, Ibaraki (JP); Yasushi Soneda, Ibaraki (JP); Masaya Kodama, Ibaraki (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 480 days.

(21) Appl. No.: 16/658,954

(22) Filed: Oct. 21, 2019

(65) Prior Publication Data

US 2020/0056305 A1 Feb. 20, 2020

Related U.S. Application Data

(62) Division of application No. 15/309,430, filed as application No. PCT/JP2015/062604 on Apr. 24, 2015, now abandoned.

(30) Foreign Application Priority Data

May 8, 2014 (JP) ..... 2014-096576

(51) Int. Cl.

| | |
|---|---|
| ***C08G 73/18*** | (2006.01) |
| ***D01D 5/06*** | (2006.01) |
| ***D01F 9/24*** | (2006.01) |
| ***D01F 6/74*** | (2006.01) |
| *D01F 9/00* | (2006.01) |

(52) U.S. Cl.

CPC ..... *D01F 9/24* (2013.01); *D01F 6/74* (2013.01); *D01F 9/00* (2013.01); *D10B 2331/14* (2013.01)

(58) Field of Classification Search

CPC ..... C08G 73/18; D01D 5/06; D01F 6/74; D01F 9/24; D10B 2331/14

USPC ..... 264/29.2, 29.6, 178 F, 184, 211.14, 264/211.15, 331.11; 423/447.7; 528/206, 528/211, 219, 288, 308, 335, 342, 348, 528/424

See application file for complete search history.

(56) References Cited

U.S. PATENT DOCUMENTS

| | | | | |
|---|---|---|---|---|
| 3,528,774 | A | 9/1970 | Ezekiel et al. | |
| 3,619,453 | A | 11/1971 | Riggs | |
| 3,634,035 | A | 1/1972 | Stuetz et al. | |
| 3,635,675 | A | 1/1972 | Ezekiel | |
| 3,903,248 | A | 9/1975 | Kalnin et al. | |
| 4,505,843 | A * | 3/1985 | Suzuki | H01B 1/127 252/500 |
| 4,533,693 | A * | 8/1985 | Wolfe | C08G 73/18 528/342 X |
| 5,772,942 | A | 6/1998 | Teramoto et al. | |
| 5,932,688 | A | 8/1999 | Murata | |
| 2006/0019094 | A1 | 1/2006 | Lee | |
| 2006/0083923 | A1 * | 4/2006 | Abe | D01F 6/74 428/395 |
| 2007/0104948 | A1 | 5/2007 | Kiriyama et al. | |
| 2010/0222544 | A1 | 9/2010 | Chokai et al. | |
| 2010/0233451 | A1 * | 9/2010 | Kitagawa | D01D 5/06 428/213 |
| 2010/0300132 | A1 | 12/2010 | Shultz et al. | |
| 2013/0018148 | A1 | 1/2013 | Knoff et al. | |

FOREIGN PATENT DOCUMENTS

| | | | |
|---|---|---|---|
| EP | 1947222 | A1 | 7/2008 |
| JP | 47-21906 | | 6/1972 |
| JP | 2008-507637 | A | 3/2008 |
| KR | 10-0494204 | B1 | 10/2005 |
| KR | 10-2007-0033001 | | 3/2007 |
| WO | 2012097266 | A1 | 7/2012 |

OTHER PUBLICATIONS

Extended European Search Report dated Nov. 23, 2017, for corresponding European Patent Application No. EP 15 78 8589, corresponding to Parent Application, U.S. Appl. No. 15/309,430.

International Search Report dated Jul. 28, 2015, for International Patent Application No. PCT/JP2015/062604. (With English Translation), corresponding to Parent Application, U.S. Appl. No. 15/309,430.

Written Opinion dated Jul. 28, 2015, for International Patent Application No. PCT/JP2015/062604. (With English Translation), corresponding to Parent Application, U.S. Appl. No. 15/309,430.

International Preliminary Report on Patentability dated Nov. 8, 2016, for International Patent Application No. PCT/JP2015/062604. (English Translation), corresponding to Parent Application, U.S. Appl. No. 15/309,430.

Non-Final Office Action dated Apr. 9, 2019 for Parent Application, U.S. Appl. No. 15/309,430.

Final Office Action dated Jul. 23, 2019 for Parent Application, U.S. Appl. No. 15/309,340.

Office Action mailed by the Korean Intellectual Property Office dated Oct. 18, 2017, for Korean Patent Application No. 10-2016-7034289 corresponding to Parent Application, U.S. Appl. No. 15/309,430.

Proceedings of the 39th Annual Meeting of The Carbon Society of Japan on "Preparation of carbon fibers from solvent-soluble aromatic polymers", dated 2012, pp. 3B02 to 3B03. (English Translation).

* cited by examiner

*Primary Examiner* — Leo B Tentoni

(74) *Attorney, Agent, or Firm* — Pergament & Cepeda LLP; Milagros A. Cepeda; Edward D. Pergament

(57) ABSTRACT

The present application provides methods for producing polybenzimidazole carbon fiber that does not require infusibilization treatment.

8 Claims, 9 Drawing Sheets

METHOD FOR PRODUCING A POLYBENZIMIDAZOLE CARBON FIBER

This application is a Divisional of U.S. patent application Ser. No. 15/309,430, filed Nov. 7, 2016, which is a National Phase application under 35 U.S.C. 371 of International Application No. PCT/JP2015/062604, filed on Apr. 24, 2015, which claims priority to Japanese provisional application No. 2014-096576, filed on May 8, 2014, all of which are hereby incorporated by references in their entireties.

TECHNICAL FIELD

The present invention relates to a polybenzimidazole carbon fiber made from a fiber material that is a precursor fiber including polybenzimidazole; and a method for producing the same.

BACKGROUND ART

Carbon fibers have been used in a wide variety of applications from aircraft to building materials. If their productivity is improved and their cost is lowered more and more, they can be materials in place of stainless steel plates also in automobile body and the like. At present, carbon fibers are mainly produced using polyacrylonitrile (PAN) fibers and pitch fibers as fiber raw materials (fiber precursor fibers).

These precursor fibers, however, require a pre-treatment called an infusibilization treatment prior to carbonization, and this treatment is a major obstacle to reduction in cost and energy required for their production, and to increase in productivity.

Specifically, because PAN fibers and pitch fibers are fused in the course of a carbonization treatment (a high-temperature thermal treatment of 1,000° C. or more) and cannot maintain their fiber shapes, they are changed to infusible, flame-resistant fibers by an air oxidization treatment called an infusibilization treatment and then are subjected to carbonization, to thereby obtain carbon fibers. In this infusibilization treatment, it is necessary to uniformly control oxidation reaction and also strictly manage temperature conditions for suppressing thermal runaway due to exothermic reaction, and moreover its treatment time is long (about 30 minutes to about 1 hour).

Therefore, the present inventors have studied various precursor fibers that do not require the infusibilization treatment, and have presented research reports of PBI carbon fibers obtained from polybenzimidazole (hereinafter referred to as "PBI") fiber serving as precursor fibers (see Proceedings of the 39th Annual Meeting of The Carbon Society of Japan, 3B02, 3B03 (2012)). The PBI fibers can be carbonized while maintaining their fiber shape without performing the infusibilization treatment.

In existing reports, it is known that PBI fibers are spun and carbonized to thereby obtain carbon fibers having an elastic modulus of 80 GPa and a strength of 670 MPa (see U.S. Pat. No. 3,528,774). Moreover, it is known that carbon fibers having a diameter of more than 100 μm can be produced by treating PBI fibers being basic with an acid solvent to thereby form salts. Moreover, it is believed that the above-described PBI fibers have an elastic modulus of 100 GPa and a strength of 420 MPa (see U.S. Pat. No. 3,903,248).

However, the PBI carbon fibers obtained by carbonizing the PBI fibers have low elastic modulus and low strength, which is problematic. Therefore, the PBI carbon fibers are required to be improved in both elastic modulus and strength for practical applications.

On the other hand, known is a method for removing, from fibers, polyphosphoric acid used in production of polymers by contacting the PBI fibers with a neutralization solution as a method for improving the PBI fibers serving as a precursor fiber in strength (see, for example, Japanese Patent Application Laid-Open (JP-A) No. 2008-507637).

However, carbon fibers obtained from the above-described PBI fibers serving as precursor fibers have not been known. Moreover, the PBI carbon fibers having sufficient elastic modulus and strength for practical applications have not been found yet. That is, elastic modulus and strength of a precursor fiber do not always correspond to elastic modulus and strength of a carbon fiber obtained by carbonizing this precursor fiber. Moreover, whether the carbon fiber can achieve intended elastic modulus and strength is unknown. Therefore, there has been a demand that the PBI carbon fibers having sufficient elastic modulus and strength for practical applications are newly developed.

SUMMARY OF INVENTION

Technical Problem

The present invention aims to solve the above problems in the existing technique and achieve the following object. That is, an object of the present invention is to provide: a PBI carbon fiber that can be efficiently produced without an infusibilization treatment and is excellent in elastic modulus and strength; and a method for producing the PBI carbon fiber.

Solution to Problem

Means for solving the above problems are as follows.

In one aspect, the present invention provides a polybenzimidazole carbon fiber including:

a structure obtained by turning a precursor fiber including polybenzimidazole into a carbon fiber under application of heat, wherein the polybenzimidazole includes a structure represented by General Formula (1) or General Formula (2) below as a structural unit, and wherein the polybenzimidazole carbon fiber has an elastic modulus in tension of 100 GPa or more and a tensile strength of 0.8 GPa or more:

(1)

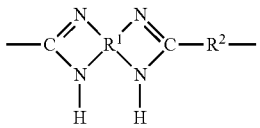

(2)

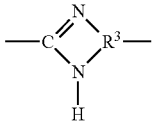

where in the General Formulas (1) and (2), $R^1$ and $R^3$ each represent a trivalent or tetravalent group of one selected from the group consisting of aryl groups and unsaturated heterocyclic groups that are expressed by any one of Structural Formulas (1) to (10) below, and $R^2$ represents a bivalent group of one selected from the group consisting of aryl groups and unsaturated heterocyclic groups that are expressed by any one of the Structural Formulas (1) to (10), alkenylene groups including from 2 to 4 carbon atoms, an oxygen atom, a sulfur atom, and a sulphonyl group:

(1)

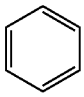

(2)

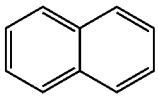

(3)

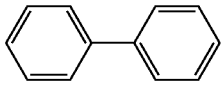

(4)

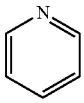

(5)

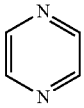

(6)

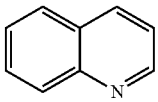

(7)

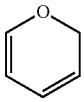

(8)

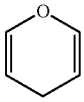

(9)

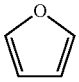

(10)

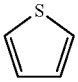

In one variant, the present invention provides the polybenzimidazole carbon fiber according to the present invention, wherein the polybenzimidazole carbon fiber is a continuous fiber having a fiber diameter of 8 μm or more.

In another aspect, the present invention provides a method for producing a polybenzimidazole carbon fiber, the method including:

spinning, in an acid solution, a polymer including polybenzimidazole including a structure represented by General Formula (1) or General Formula (2) below as a structural unit, to thereby obtain a first precursor fiber of the polymer;

contacting the first precursor fiber with a basic solution, and neutralizing the acid solution remaining in the first precursor fiber to be removed, to thereby obtain a second precursor fiber; and heating the second precursor fiber at a temperature of from 1,000° C. to 1,600° C. under an inert gas, to thereby turn the second precursor fiber into a carbon fiber:

(1)

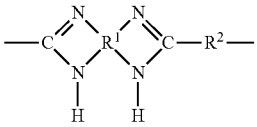

(2)

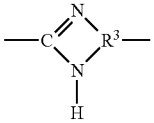

where in the General Formulas (1) and (2), $R^1$ and $R^3$ each represent a trivalent or tetravalent group of one selected from the group consisting of aryl groups and unsaturated heterocyclic groups that are expressed by any one of Structural Formulas (1) to (10) below, and $R^2$ represents a bivalent group of one selected from the group consisting of aryl groups and unsaturated heterocyclic groups that are expressed by any one of the Structural Formulas (1) to (10), alkenylene groups including from 2 to 4 carbon atoms, an oxygen atom, a sulfur atom, and a sulphonyl group:

(1)

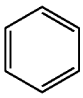

(2)

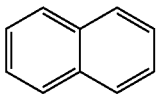

(3)

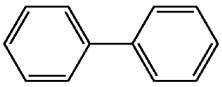

(4)

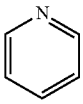

(5)

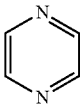

(6)

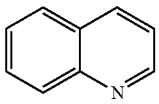

(7)

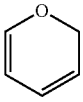

(8)

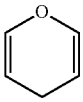

(9)

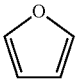

-continued (10)

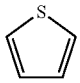

In one variant, the present invention provides the method for producing a polybenzimidazole carbon fiber according to the present invention, wherein the acid solution is polyphosphoric acid and the basic solution is an ethanol solution of triethylamine.

In one variant, the present invention provides the method for producing a polybenzimidazole carbon fiber according to the present invention, wherein the contacting is allowing the first precursor fiber to pass through a bath of the ethanol solution of triethylamine for from 5 seconds to 30 seconds to neutralize the polyphosphoric acid remaining in the first precursor fiber to be removed.

In one variant, the present invention provides the method for producing a polybenzimidazole carbon fiber according to the present invention, wherein the spinning further includes: coagulating, in a coagulation bath, a reaction solution of the polymer obtained through polymerization in a first acid solution, to thereby obtain a first coagulated matter of the polymer; contacting the first coagulated matter with a first basic solution to neutralize the first acid solution remaining in the first coagulated matter to be removed, to thereby obtain a second coagulated matter; and dissolves the second coagulated matter in a second acid solution to prepare a raw liquid for spinning, and spins the raw liquid for spinning, to thereby obtain a first precursor fiber of the polymer, and wherein the contacting is contacting the first precursor fiber with a second basic solution, and neutralizing the second acid solution remaining in the first precursor fiber to be removed, to thereby obtain a second precursor fiber.

In one variant, the present invention provides the method for producing a polybenzimidazole carbon fiber according to the present invention, wherein the first acid solution is polyphosphoric acid, the first basic solution is an aqueous sodium hydrogen carbonate solution, the second acid solution is methanesulfonic acid, and the second basic solution is an ethanol solution of triethylamine.

In one variant, the present invention provides the method for producing a polybenzimidazole carbon fiber according to the present invention, wherein the contacting is allowing the first precursor fiber to pass through a bath of the ethanol solution of triethylamine for from 5 seconds to 30 seconds, and neutralizing the methanesulfonic acid remaining in the first precursor fiber to be removed.

In one variant, the present invention provides the method for producing a polybenzimidazole carbon fiber according to the present invention, wherein a heating temperature of the heating is a temperature of from 1,200° C. to 1,400° C.

Advantageous Effects of Invention

According to the present invention, it is possible to solve the above problems in the existing technique and to provide: a PBI carbon fiber that can be efficiently produced without an infusibilization treatment and is excellent in elastic modulus and strength; and a method for producing the PBI carbon fiber.

DESCRIPTION OF EMBODIMENTS (PBI Carbon Fiber)

Figure 1A:
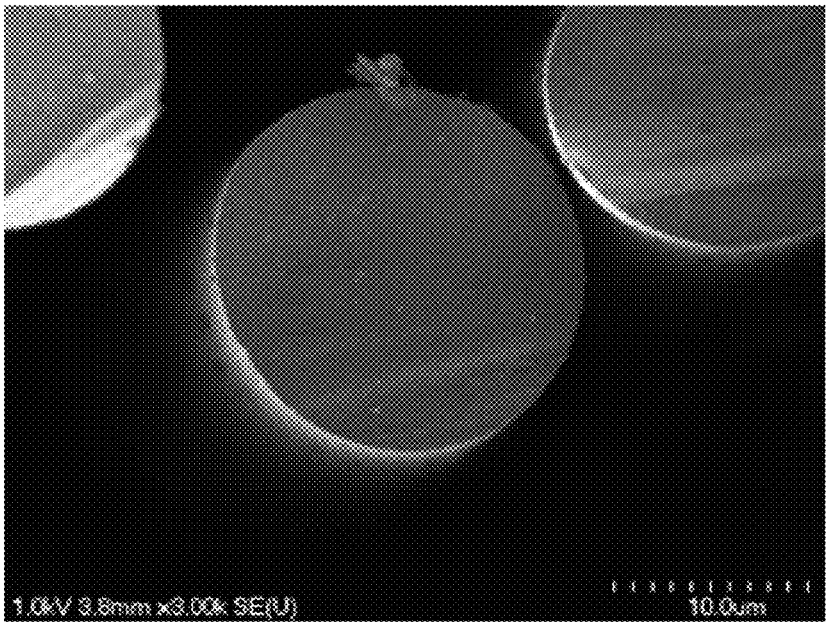
FIG. 1A is an image presenting cross sections of PBI carbon fibers according to Example 3 obtained through an electron microscope.

A polybenzimidazole (PBI) carbon fiber of the present invention includes a structure obtained by turning a precursor fiber including PBI into a carbon fiber under application of heat. The PBI includes a structure represented by the following General Formula (1) or General Formula (2) as a structural unit. The PBI carbon fiber has an elastic modulus in tension of 100 GPa or more and a tensile strength of 0.8 GPa or more.

(1)

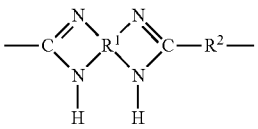

(2)

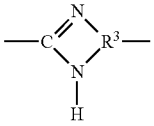

In the General Formulas (1) and (2), $R^1$ and $R^3$ each represent a trivalent or tetravalent group of one selected from the group consisting of aryl groups and unsaturated heterocyclic groups that are expressed by any one of the following Structural Formulas (1) to (10), and $R^2$ represents a bivalent group of one selected from the group consisting of aryl groups and unsaturated heterocyclic groups that are expressed by any one of the Structural Formulas (1) to (10), alkenylene groups including from 2 to 4 carbon atoms, an oxygen atom, a sulfur atom, and a sulphonyl group.

(1)

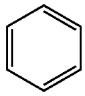

(2)

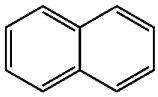

(3)

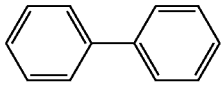

(4)

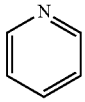

(5)

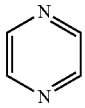

(6)

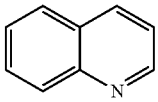

(7)

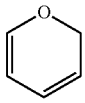

(8)

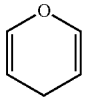

(9)

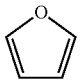

(10)

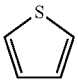

Examples of the alkenylene group include a vinylene group.

The precursor fiber including the above PBI (PBI precursor fiber) can be carbonized while maintaining its fiber shape even without an infusibilization treatment. Therefore, the carbon fibers can be efficiently produced compared to carbon fibers obtained from precursor fibers such as PAN fibers or pitch fibers, which require the infusibilization treatment.

In addition, the PBI precursor fiber can be carbonized with high carbonization yield. Therefore, it is possible to suppress distortion of structures due to pyrolysis gas generated and released during carbonization, and/or generation of voids (pores) (including foaming) which would reduce the mechanical strength of carbon fibers. Moreover, partly because the carbonization yield is high; i.e., the amount of gas and/or tar released by pyrolysis during carbonization is small, even in the case where carbonization is performed under rapid heating, it is possible to avoid instant generation of a large amount of decomposition gas, which makes it possible to perform carbonization treatment very rapidly. Thereby, it is possible to carbonize thick fibers having large volumes relative to their outer surfaces so that gas does not easily escape during carbonization.

The PBI carbon fiber has an elastic modulus in tension of 100 GPa or more and a tensile strength of 0.8 GPa or more; i.e., it is excellent in both elastic modulus and strength.

The reason why the PBI carbon fiber can achieve the above-described elastic modulus and strength is because an acid solution in the PBI precursor fiber is neutralized by a basic solution to be removed in the below-described production method. The invention of the PBI carbon fiber is based on the finding that the precursor fiber obtained through the above-described neutralization for removal can be turned into a carbon fiber while maintaining a fiber structure of the precursor fiber.

Here, the elastic modulus in tension and the tensile strength can be measured by a single fiber tensile test according to the JIS7606 method.

As described above, the PBI carbon fiber can maintain high elastic modulus and high strength even if a thick fiber is carbonized to have a larger diameter. Commercially available products of carbon fibers (e.g., PAN carbon fibers) generally have a fiber diameter of about 7 μm. However, the PBI carbon fiber can maintain high elastic modulus and high strength not only when the fiber diameter is a small diameter of from 2 μm to 8 μm (exclusive) but also when the fiber diameter is 8 μm or more, and is further increased to a large thickness of 16 μm or more. Here, the upper limit of the fiber diameter is about 30 μm.

Moreover, the PBI carbon fiber can be a continuous fiber (filament).

The above-described PBI carbon fiber according to the present invention can be produced by a method for producing the PBI carbon fiber according to present invention, which will be described hereinafter.

(Method for Producing PBI Carbon Fiber)

The method for producing the PBI carbon fiber includes a step of obtaining a first precursor fiber, a step of obtaining a second precursor fiber, and a step of producing a carbon fiber.

<Step of Obtaining First Precursor Fiber>

The step of obtaining a first precursor fiber is a step of spinning, in an acid solution, a polybenzimidazole-including polymer having a structure expressed by the General Formula (1) or (2) as a structural unit, to thereby obtain a first precursor fiber of the polymer.

(1)

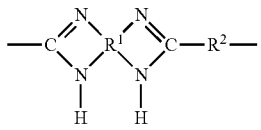

(2)

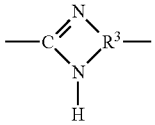

In the General Formulas (1) and (2), $R^1$ and $R^3$ each represent a trivalent or tetravalent group of one selected from the group consisting of aryl groups and unsaturated heterocyclic groups that are expressed by any one of Structural Formulas (1) to (10) below, and $R^2$ represents a bivalent group of one selected from the group consisting of aryl groups and unsaturated heterocyclic groups that are expressed by any one of the Structural Formulas (1) to (10), alkenylene groups including from 2 to 4 carbon atoms, an oxygen atom, a sulfur atom, and a sulphonyl group.

(1)

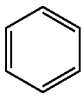

(2)

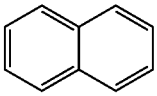

(3)

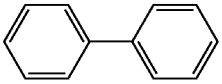

(4)

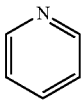

(5)

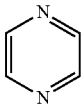

(6)

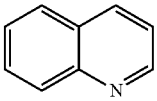

(7)

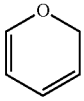

(8)

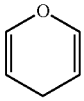

(9)

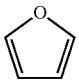

(10)

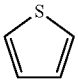

Examples of the alkenylene group include a vinylene group.

The PBI may be a commercially available product or may be synthesized.

When the PBI is synthesized, it can be obtained by allowing, in the acid solution, terephthalic acid (available from, for example, Wako Pure Chemical Industries, Ltd.) and 4,4'-biphenyl-1,1',2,2'-tetramine (available from, for example, Aldrich) as starting materials to proceed to polycondensation reaction.

The polymer may be the PBI itself. Alternatively, the polymer may be a copolymer formed of a structural unit of the PBI and another structural unit, or a polymer blend material obtained by combining the PBI with another polymer so long as the effects of the present invention are not deteriorated.

The precursor fiber may be a fiber material obtained from the polymer itself. However, the precursor fiber may be a fiber material obtained by adding any substituent to a terminal of the polymer so long as the effects of the present invention are not deteriorated.

Examples of the any substituent include an ester group, an amide group, an imide group, a hydroxyl group, and a nitro group.

Methods of the spinning can be roughly divided into the following two methods: a first method and a second method. The first method can be performed by directly spinning, as a raw liquid for spinning, a reaction solution obtained by allowing the polymer to proceed to polycondensation reaction in the acid solution. The second method can be performed in the following manner. Specifically, the acid solution constituting the reaction solution is regarded as a first acid solution. A coagulated matter of the polymer is first obtained from the reaction solution, and then the coagulated matter is dissolved in a second acid solution for spinning, to thereby obtain a reaction solution as a raw liquid for spinning. Then, the raw liquid for spinning is spun.

The acid solution used for the first method is not particularly limited so long as it can dissolve the starting materials and the polymer to be produced and can serve as a catalyst that promotes polymerization. Specific examples of the acid solution include polyphosphoric acid, polyphosphate ester, diphenyl cresyl phosphate, and methanesulfonic acid in which diphenyl cresyl phosphate or diphosphorus pentaoxide is dissolved. Among them, the polyphosphoric acid is preferable in terms of controlling the polymerization reaction.

When the spinning is performed by the second method, the step of obtaining a first precursor fiber includes a step of obtaining a first coagulated matter and a step of obtaining a second coagulated matter. In addition, the step of obtaining a first precursor fiber is a step of obtaining a first precursor fiber of the polymer by spinning a raw liquid for spinning, the raw liquid for spinning being prepared by dissolving, in a second acid solution, the second coagulated matter obtained in the step of obtaining a second coagulated matter.

—Step of Obtaining First Coagulated Matter—

The step of obtaining a first coagulated matter is a step of coagulating, in the first acid solution, the reaction solution of the polymer obtained through polymerization in a coagulation bath, to thereby obtain a first coagulated matter of the polymer.

The first acid solution can be the same one as the acid solution used in the first method.

A coagulation liquid in the coagulation bath is not particularly limited so long as the polymer can be coagulated. Examples of the coagulation liquid include water, alcohol, methanesulfonic acid, polyphosphoric acid, and dilute sulfuric acid. Among them, the water is preferable.

—Step of Obtaining Second Coagulated Matter—

The step of obtaining a second coagulated matter is a step of contacting the first coagulated matter with a first basic solution, and neutralizing the first acid solution remaining in the first coagulated matter to be removed, to thereby obtain a second coagulated matter.

The first basic solution is not particularly limited so long as it neutralizes the first acid solution. Examples of the first basic solution include an aqueous sodium hydrogen carbonate solution, an aqueous sodium hydroxide solution, potassium hydroxide, and an ethanol solution of triethylamine. Among them, the aqueous sodium hydrogen carbonate solution is preferable because reduction in a degree of polymerization can be prevented.

Here, the coagulated matter may be washed with water or alcohol before or after washed with the first basic solution.

When the spinning is performed by the second method as described above, the second coagulated matter that has been washed is dissolved in the second acid solution to prepare the raw liquid for spinning.

The second acid solution is not particularly limited so long as the second coagulated matter can be dissolved. Examples of the second acid solution include methanesulfonic acid, polyphosphoric acid, and concentrated sulfuric acid. Among them, the methanesulfonic acid is preferable because it can impart viscosity suitable for the spinning to the raw liquid for spinning.

The spinning method in the first method and the second method is not particularly limited and may be appropriately selected depending on the intended purpose. Examples of the spinning method include known wet-type spinning methods and known dry-type spinning methods.

Note that, the first precursor fiber and a second precursor fiber that will be described hereinafter may be subjected to drawing treatment•thermal treatment if necessary. Regarding the drawing treatment, spun yarn may be directly drawn in a coagulation bath, or wound yarn may be washed with water and then drawn in the bath. The drawing treatment and the thermal treatment may be performed at the same time. Regarding the thermal treatment, an atmosphere is not particularly limited, but the thermal treatment is preferably performed in air or in a nitrogen atmosphere. A temperature and time of the thermal treatment may be appropriately selected, but the temperature of the thermal treatment is preferably from 200° C. to 600° C. Moreover, a draw ratio is preferably from about 1.2 times to about 10 times.

As described above, the first precursor fiber can be obtained.

<Step of Obtaining Second Precursor Fiber>

The step of obtaining a second precursor fiber is a step of contacting the first precursor fiber with a basic solution, and neutralizing the acid solution remaining in the first precursor fiber to be removed, to thereby obtain a second precursor fiber.

When the step of obtaining a first precursor fiber is performed by the first method, the basic solution used in the step of obtaining a second precursor fiber is not particularly limited so long as it neutralizes the acid solution. Examples of the basic solution include an ethanol solution of triethylamine, an aqueous sodium hydrogen carbonate solution, an aqueous sodium hydroxide solution, and potassium hydroxide. The ethanol solution of triethylamine is preferable because an excess amount of alkali remaining in fibers after neutralization reaction is easily removed.

Moreover, a method of the contacting is not particularly limited and may be performed by spraying the basic solution to the first precursor fiber. However, the first precursor fiber is preferably allowed to pass through a bath of the basic solution.

In particular, when the step of obtaining a first precursor fiber is performed by the first method, and when the acid solution is the polyphosphoric acid and the basic solution is the ethanol solution of triethylamine, it is preferable that the first precursor fiber be allowed to pass through a bath of the ethanol solution of triethylamine for from 5 seconds to 30 seconds.

The above-described method can effectively neutralize the acid solution in the first precursor fiber to be removed.

Here, the precursor fiber may be washed with water or alcohol before or after washed with the basic solution.

When the step of obtaining a first precursor fiber is performed by the second method, the step of obtaining a second precursor fiber is performed as a step of contacting the first precursor fiber with a second basic solution, and neutralizing the second acid solution remaining in the first precursor fiber to be removed, to thereby obtain a second precursor fiber.

The second basic solution is not particularly limited so long as it can neutralize the second acid solution. Examples of the second basic solution include an ethanol solution of triethylamine, an aqueous sodium hydrogen carbonate solution, an aqueous sodium hydroxide solution, and potassium hydroxide. Among them, the ethanol solution of triethylamine is preferable because excess of alkali remaining in fibers after neutralization reaction is easily removed.

A method of the contacting is not particularly limited and may be performed by spraying the second basic solution to the first precursor fiber. However, the first precursor fiber is preferably allowed to pass through a bath of the second basic solution.

In particular, when the second acid solution is the methanesulfonic acid and the second basic solution is the ethanol solution of triethylamine, the first precursor fiber is preferably allowed to pass through a bath of the ethanol solution of triethylamine for from 5 seconds to 30 seconds.

The above-described method can effectively neutralize the second acid solution in the first precursor fiber to be removed.

Here, the precursor fiber may be washed with water or alcohol before or after washed with the second basic solution.

<Step of Producing Carbon Fibers>

The step of producing carbon fibers is a step of heating the second precursor fiber at a temperature of from 1,000° C. to 1,600° C. in an inert gas atmosphere to turn the second precursor fiber into a carbon fiber.

When a heating temperature in the step of producing carbon fibers is from 1,200° C. to 1,400° C., the PBI carbon fibers that are more excellent in elastic modulus and strength can be produced.

Moreover, as described above, the PBI fibers have property of maintaining their fiber shapes even if the PBI fibers are subjected to high-speed carbonization treatment at a rapid temperature increasing rate.

Therefore, a temperature increasing rate in the heating is not particularly limited and can be the following: from such a low-speed temperature increasing rate as 5° C./min through such a high-speed temperature increasing rate as a range of from 15° C./sec to 1,000° C./sec.

Here, the inert gas is not particularly limited. Examples of the inert gas include nitrogen and argon gas.

The method for producing the PBI carbon fiber may further include a step of graphitizing the PBI carbon fibers. This step is performed by heating the PBI carbon fibers at higher temperature after the step of producing carbon fibers or successively after the step of producing carbon fibers, in order to control mechanical properties (e.g., elastic modulus and strength) of the PBI carbon fibers obtained through the carbonization.

A heating temperature in the graphitizing step (a heating step to be performed successively with the carbonization step in some cases) is not particularly limited but is preferably from 2,000° C. to 3,200° C. Setting the heating temperature in such a range makes it possible to produce the carbon fibers having sufficient mechanical properties at high carbonization yield and high density.

Note that, the graphitizing step is preferably performed in an inert gas similar to the step of producing carbon fibers.

Note that, the method for producing the PBI carbon fiber may further include a surface treatment and a step of performing application of sizing performed in known processes of producing carbon fibers.

EXAMPLES (Preparation of Precursor Fiber)

<PBI Precursor Fiber 1>

First, terephthalic acid (1 mol) (available from Wako Pure Chemical Industries, Ltd., Distributor Code No. 208-08162) and 4,4'-biphenyl-1,1',2,2'-tetraamine (1 mol) (available from Aldrich, Distributor Code No. D12384), each of which is a raw material of a polymer, were allowed to proceed to polycondensation reaction in polyphosphoric acid (available from Sigma-Aldrich, Distributor Code No. 208213) serving as a first acid solution, to thereby prepare a reaction solution including poly2,2'-(p-phenylene)-5,5'-bibenzimidazole as a PBI polymer.

Next, the reaction solution was charged into a water bath serving as a coagulation bath. Then, the PBI polymer was coagulated so as to have a fiber shape, to thereby obtain a first coagulated matter (step of obtaining a first coagulated matter).

The first coagulated matter was stirred in dimethylacetamide (DMAc) to wash impurities. Then, the first coagulated matter was stirred in an aqueous sodium hydrogen carbonate solution (concentration: 5 wt %) to neutralize the first acid solution in the first coagulated matter to be removed, to thereby obtain a second coagulated matter of the PBI polymer. Next, the second coagulated matter was washed with water and alcohol, and was dried at 240° C. under vacuum for 1 day (step of obtaining a second coagulated matter).

Note that, it is known that polycondensation reaction of the PBI polymer proceeds in a substantially quantitative manner. It was confirmed that when the step of obtaining a second coagulated matter was omitted and the first coagulated matter was directly dried, a yield; i.e., an amount relative to a theoretically determined amount of the PBI polymer in the first coagulated matter was 110% or more, which means that the first acid solution (polyphosphoric acid) remained in the PBI polymer. When the step of obtaining a second coagulated matter was performed, the yield was about 98%.

Next, the second coagulated matter was dissolved in methanesulfonic acid (available from Wako Pure Chemical Industries, Ltd., Distributor Code No. 138-01576) serving as a second acid solution, to thereby prepare a raw liquid for spinning, the raw liquid including the second coagulated matter in an amount of 3.2 wt %.

By wet-type spinning, the raw liquid for spinning was charged into a water bath serving as a coagulation bath, and was allowed to pass through a multi-hole nozzle member including 402 nozzle holes, to thereby eject a fiber bundle of 402 fibers. The fiber bundle was wound by a winding device, to thereby obtain a first precursor fiber of the PBI polymer (step of obtaining a first precursor fiber). Here, the wet-type spinning was performed under application of tension so that a jet stretch ratio represented by winding speed/discharge linear velocity was 1.5. Moreover, a diameter of each of the nozzle holes of the multi-hole nozzle member was set so that a diameter of one first precursor fiber constituting the fiber bundle was 20 μm.

Next, the first precursor fiber was allowed to pass through a bath of an ethanol solution of triethylamine serving as a second basic solution for 30 seconds. Then, the second acid solution in the first precursor fiber was neutralized to be removed, to thereby obtain a second precursor fiber of the PBI polymer. After that, the second precursor fiber was washed with water and was dried (step of obtaining a second precursor fiber).

In order to confirm whether the second acid solution in the obtained second precursor fiber remains or not, CHNS elemental analysis was performed. Here, the CHNS elemental analysis is performed by detecting a sulfur component (S component) in the methanesulfonic acid serving as the second acid solution.

As a result of the analysis, it was confirmed that the sulfur component (S component) was not detected in the second precursor fiber and the methanesulfonic acid was completely neutralized to be removed.

As described above, PBI precursor fiber 1 serving as the second precursor fiber was prepared.

<PBI Precursor Fiber 2>

PBI precursor fiber 2 was prepared in the same manner as in the method for preparing the PBI precursor fiber 1 except that a diameter of each of the nozzle holes of the multi-hole nozzle member was changed for adjustment so that a diameter of one fiber was 11 μm.

<PBI Precursor Fiber 3>

In the preparation of the PBI precursor fiber 1, the step of obtaining a second precursor fiber was omitted and was replaced with the following procedures. Specifically, the first precursor fiber was allowed to pass through a bath of water for 30 seconds. Then, the first precursor fiber was washed with water and was dried, to thereby obtain the second precursor fiber.

PBI precursor fiber 3 was prepared in the same manner as in the method for preparing the PBI precursor fiber 1 so that a diameter of one fiber was 11 μm.

When the PBI precursor fiber 3 was subjected to the CHNS analysis, it was confirmed that about 8% of the sulfur component (S component) was detected in the second precursor fiber and the methanesulfonic acid was not completely neutralized to be removed.

<PBI Precursor Fiber 4>

PBI precursor fiber 4 was prepared in the same manner as in the preparation of the PBI precursor fiber 1 except that some procedures were changed in the following manners. Specifically, the multi-hole nozzle member was replaced with a single hole nozzle member having a diameter of a nozzle hole was 250 μm. A fiber was obtained so that one fiber was adjusted to have a fiber diameter of 40 μm. The fiber was not subjected to the step of obtaining a second precursor fiber and was directly dried, to thereby obtain PBI precursor fiber 4.

(Carbonization of Precursor Fiber)

Example 1

The PBI precursor fiber 1 serving as the second precursor fiber was heated from room temperature to a predetermined heating temperature of 1,000° C. at a temperature increasing rate of 10° C./min in a nitrogen atmosphere. Moreover, the PBI precursor fiber 1 was continued in heating for 10 minutes at the predetermined heating temperature and was turned into carbon fibers, to thereby produce PBI carbon fibers according to Example 1 (step of producing carbon fibers). Here, the PBI carbon fibers according to Example 1 each had a diameter of 16 μm. Moreover, the PBI carbon fibers according to Examples 2 to 7, which will be described hereinafter, each had the same diameter as the above.

Example 2

PBI carbon fibers according to Example 2 were produced in the same manner as in the step of producing carbon fibers of Example 1 except that the predetermined heating temperature was changed from 1,000° C. to 1,100° C.

Example 3

PBI carbon fibers according to Example 3 were produced in the same manner as in the step of producing carbon fibers of Example 1 except that the predetermined heating temperature was changed from 1,000° C. to 1,200° C.

Example 4

PBI carbon fibers according to Example 4 were produced in the same manner as in the step of producing carbon fibers of Example 1 except that the predetermined heating temperature was changed from 1,000° C. to 1,300° C.

Example 5

PBI carbon fibers according to Example 5 were produced in the same manner as in the step of producing carbon fibers of Example 1 except that the predetermined heating temperature was changed from 1,000° C. to 1,400° C.

Example 6

PBI carbon fibers according to Example 6 were produced in the same manner as in the step of producing carbon fibers of Example 1 except that the predetermined heating temperature was changed from 1,000° C. to 1,500° C.

Example 7

PBI carbon fibers according to Example 7 were produced in the same manner as in the step of producing carbon fibers of Example 1 except that the predetermined heating temperature was changed from 1,000° C. to 1,600° C.

Example 8

The PBI precursor fiber 2 serving as the second precursor fiber was heated from room temperature to a predetermined heating temperature of 1,000° C. at a temperature increasing rate of 10° C./min in a nitrogen atmosphere. Moreover, the PBI precursor fiber 2 was continued in heating for 10 minutes at the predetermined heating temperature and was turned into carbon fibers, to thereby produce PBI carbon fibers according to Example 8 (step of producing carbon fibers). Here, the PBI carbon fibers according to Example 8 each had a diameter of 9 μm. Moreover, the PBI carbon fibers according to Examples 9 to 14, which will be described hereinafter, each had the same diameter as the above.

Example 9

PBI carbon fibers according to Example 9 were produced in the same manner as in the step of producing carbon fibers of Example 8 except that the predetermined heating temperature was changed from 1,000° C. to 1,100° C.

Example 10

PBI carbon fibers according to Example 10 were produced in the same manner as in the step of producing carbon fibers of Example 8 except that the predetermined heating temperature was changed from 1,000° C. to 1,200° C.

Example 11

PBI carbon fibers according to Example 11 were produced in the same manner as in the step of producing carbon fibers of Example 8 except that the predetermined heating temperature was changed from 1,000° C. to 1,300° C.

Example 12

PBI carbon fibers according to Example 12 were produced in the same manner as in the step of producing carbon fibers of Example 8 except that the predetermined heating temperature was changed from 1,000° C. to 1,400° C.

Example 13

PBI carbon fibers according to Example 13 were produced in the same manner as in the step of producing carbon fibers of Example 8 except that the predetermined heating temperature was changed from 1,000° C. to 1,500° C.

Example 14

PBI carbon fibers according to Example 14 were produced in the same manner as in the step of producing carbon fibers of Example 8 except that the predetermined heating temperature was changed from 1,000° C. to 1,600° C.

Comparative Example 1

PBI carbon fibers according to Comparative Example 1 were produced in the same manner as in the step of producing carbon fibers of Example 1 except that the PBI precursor fiber 1 was changed to the PBI precursor fiber 3 and the PBI precursor fiber 3 was turned into carbon fibers.

Comparative Example 2

PBI carbon fibers according to Comparative Example 2 were produced in the same manner as in the step of producing carbon fibers of Example 6 except that the PBI precursor fiber 1 was changed to the PBI precursor fiber 4 and the PBI precursor fiber 4 was turned into carbon fibers.

<Confirmation of Structure Using Electron Microscope>

Figure 1B:
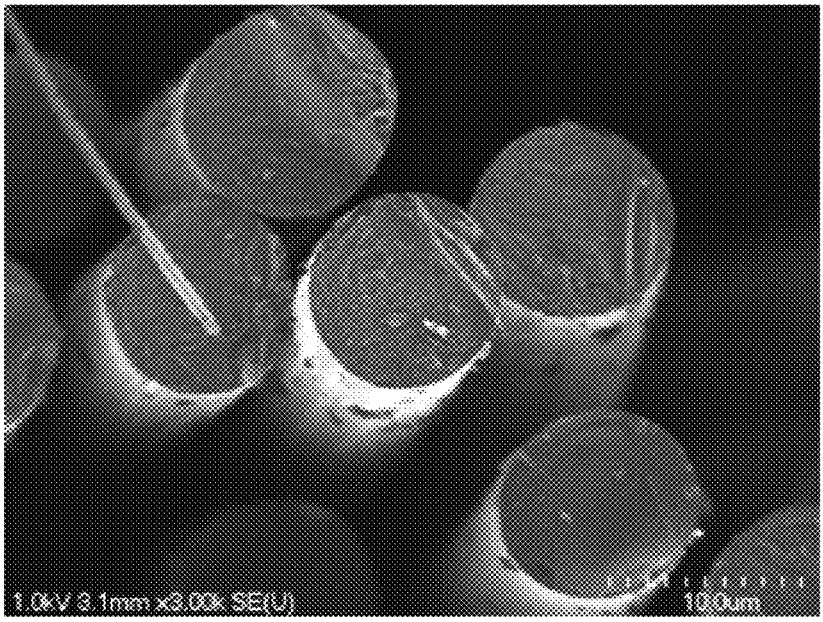
FIG. 1B is an image presenting cross sections of PBI carbon fibers according to Example 10 obtained through an electron microscope.
Figure 1C:
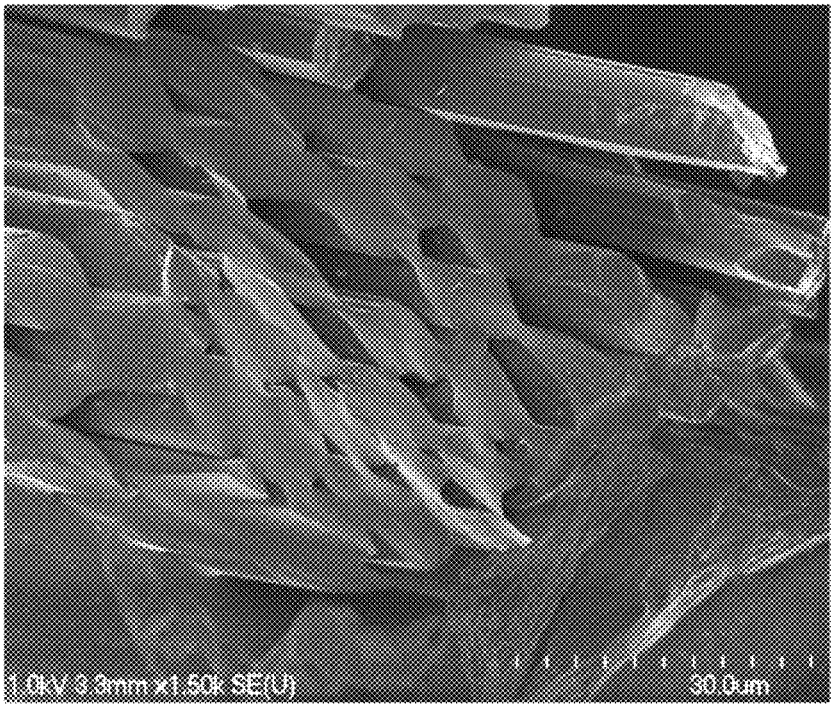
FIG. 1C is an image presenting cross sections of PBI carbon fibers according to Comparative Example 1 obtained through an electron microscope.
Figure 1D:
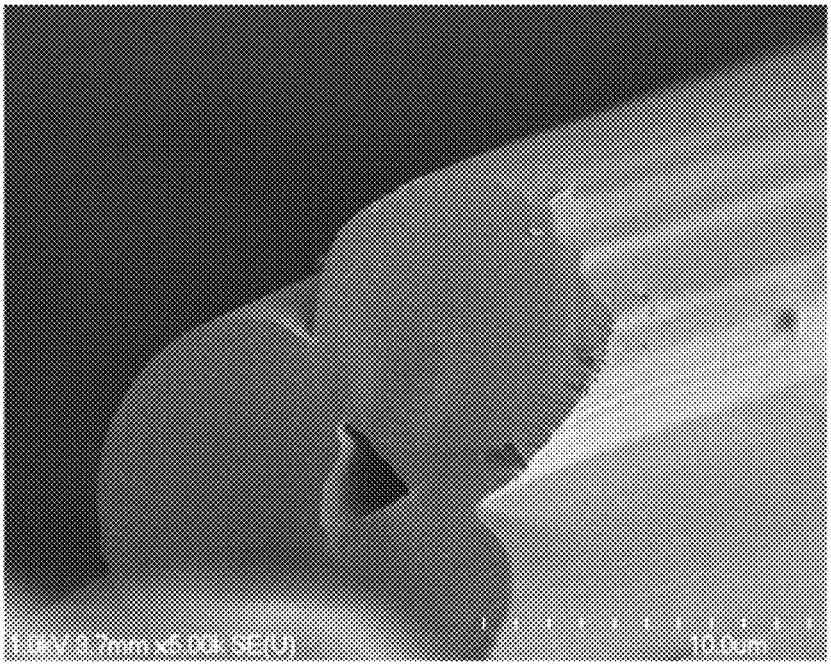
FIG. 1D is an image presenting cross sections of PBI carbon fibers according to Comparative Example 1 obtained through an electron microscope.

FIGS. 1A to 1D are images (SEM images) presenting cross sections of the PBI carbon fibers according to Example 3, Example 10, and Comparative Example 1, which are obtained through an electron microscope. Here, FIG. 1A is an image presenting cross sections of the PBI carbon fibers according to Example 3 obtained through an electron microscope; FIG. 1B is an image presenting cross sections of the PBI carbon fibers according to Example 10 obtained through an electron microscope; and FIGS. 1C and 1D are images presenting cross sections of the PBI carbon fibers according to Comparative Example 1, which are obtained through an electron microscope.

As presented in FIGS. 1A to 1D, it is confirmed that the PBI carbon fibers according to Examples 3 and 10 each have a cross-sectional shape of nearly perfect circle and are carbon fibers each of which is hardly adhered to another fiber. Meanwhile, it is confirmed that the PBI carbon fibers according to Comparative Example 1 have a cross-sectional shape of ellipse and are carbon fibers each of which is strongly adhered to another fiber.

<Single Fiber Tensile Test>

One fiber of each of the PBI carbon fibers according to Examples 1 to 14 was subjected to a single fiber tensile test according to the JIS7606 method to measure the fiber for elastic modulus in tension and tensile strength.

Figure 2A:
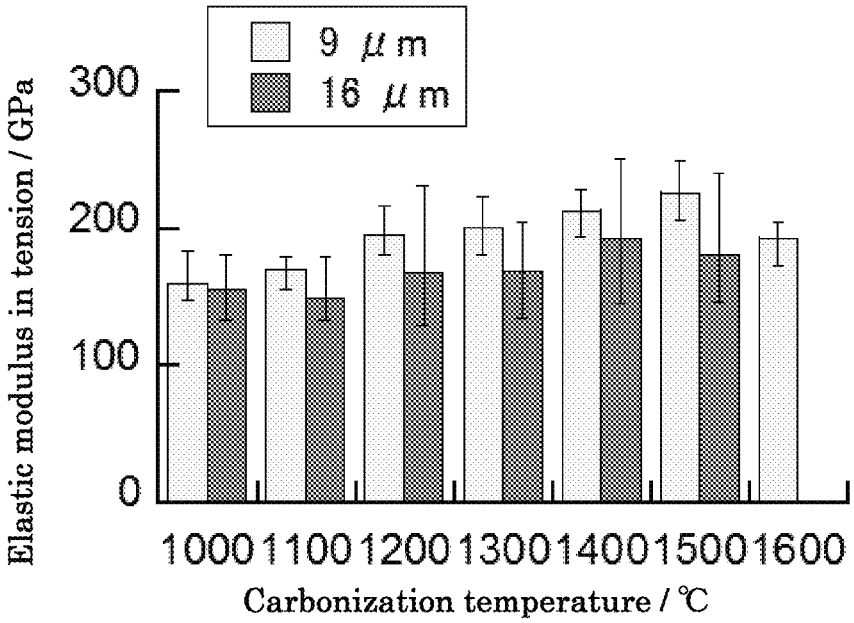
FIG. 2A is a graph presenting measurement results of elastic modulus in tension.
Figure 2B:
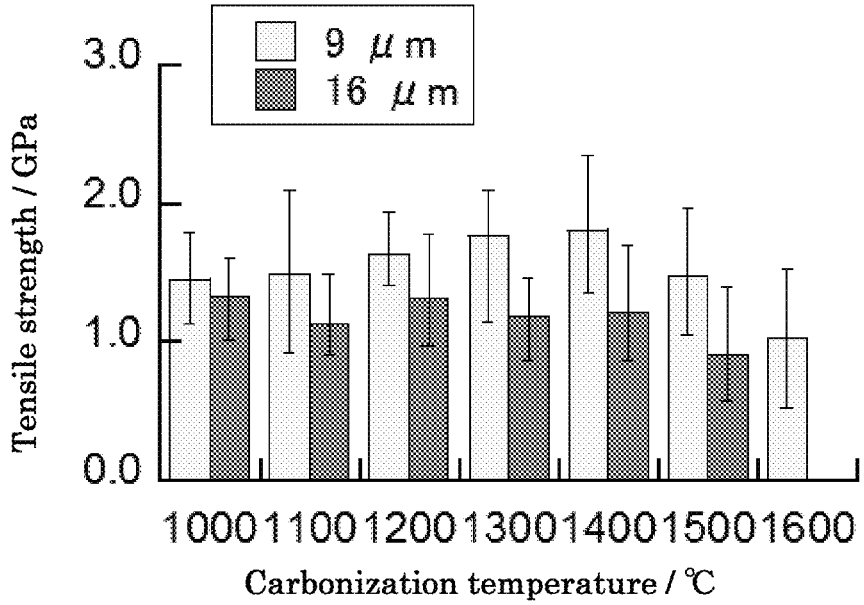
FIG. 2B is a graph presenting measurement results of tensile strength.

Measurement results are presented in FIGS. 2A and 2B. Here, FIG. 2A is a graph presenting measurement results of elastic modulus in tension, and FIG. 2B is a graph presenting measurement results of tensile strength. Each value in FIGS. 2A and 2B is presented by a histogram and is an average value determined from values of the tests performed 10 times. The error bars present both maximum values and minimum values during the test.

As presented in these FIGS. 2A and 2B, it is confirmed that all of the PBI carbon fibers according to Examples 1 to 14 have an elastic modulus in tension of 100 GPa or more, which is a high value, and have an elastic modulus in tension of 150 GPa or more, which is a higher value. Moreover, it is confirmed that all of the PBI carbon fibers have an elastic modulus in tension of 0.8 GPa or more, which is a high value. It is believed that the PBI carbon fibers of the present invention can achieve the above-described high values of elastic modulus in tension and tensile strength even if each of the PBI carbon fibers has a large diameter (e.g., 9 μm and 16 μm), which is advantageous. Among them, it is confirmed that the PBI carbon fibers according to Examples 3 to 5 and 10 to 12, which were obtained at a carbonization treatment temperature of from 1,200° C. to 1,400° C., could achieve relatively high elastic modulus in tension and relatively high tensile strength.

Note that, a single fiber could not be extracted from the PBI carbon fibers according to Comparative Example 1 because each fiber was strongly adhered to another fiber. Therefore, the PBI carbon fibers according to Comparative Example 1 could not be measured for elastic modulus in tension and tensile strength. It is believed that the obtained carbon fibers have low elastic modulus in tension and low tensile strength. This is because when solvent molecules remaining thereon as salts are released through a thermal treatment, some defects are generated in the carbon fibers, and the above-described defects serve as a starting point of breakage in the carbon fibers.

Moreover, when the PBI carbon fibers according to Comparative Example 2 were subjected to the single fiber tensile test, the PBI carbon fibers had an elastic modulus in tension of 85 GPa and a tensile strength of 720 MPa.

<Presumption of Reachable Strength>

Figure 3:
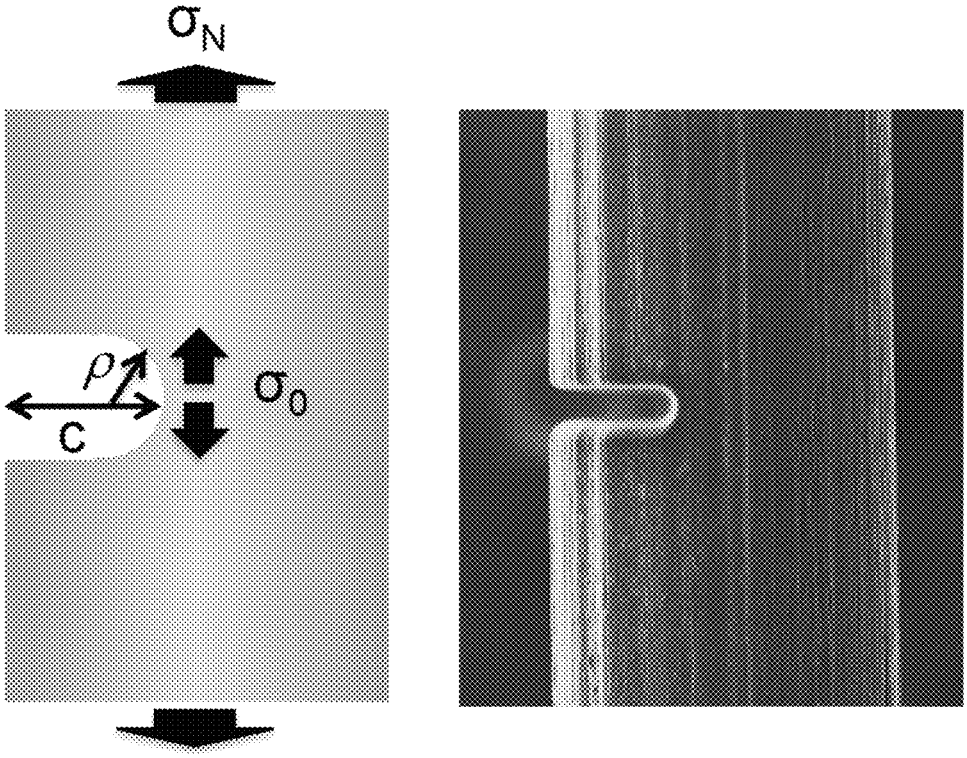
FIG. 3 is an explanatory view presenting presumption conditions of reachable strength.

The PBI carbon fibers according to Example 11 (a carbonization treatment temperature is 1,300° C.), which are particularly excellent in both elastic modulus in tension and tensile strength, were used to performed presumption of reachable strength based on the following Referential Document 1. FIG. 3 is an explanatory view presenting presumption conditions of the reachable strength. Here, the reachable strength means a defect-free strength presumed in the following manner in consideration of a notch tip portion at which stress is concentrated. Specifically, as presented in FIG. 3, a surface notch is introduced into carbon fibers through focused ion beams. The obtained carbon fibers are subjected to the aforementioned single fiber tensile test, to thereby obtain the reachable strength. This reachable strength can be calculated by the following Mathematical Formulas (1) and (2).

$$\sigma_N = \frac{1}{\alpha}\sigma_0 \tag{1}$$

$$\alpha = 1 + 2\sqrt{\frac{c}{\rho}} \tag{2}$$

Here, in the Mathematical Formulas (1) and (2), $\sigma_0$ represents reachable strength, $\sigma_N$ represents a value obtained by dividing a tensile load by a cross-sectional area of the fiber, a represents a percentage of stress concentration, c represents a notch depth, and p represents a radius of curvature of a notch tip portion.

When the PBI carbon fibers according to Example 11 were measured for the above reachable strength, it was confirmed that a presumption value of its reachable strength was 5.2 GPa, which was a considerably high value. This is because defects in the fibers can be reduced by optimizing the conditions of the step of obtaining a first precursor fiber and the step of obtaining a second precursor fiber. Thereby, it can be expected to achieve a value of tensile strength that is larger than the values obtained in the Examples.

Referential Document 1; M. Shioya, H. Inoue, Y. Sugimoto, Carbon, v65, 63-70 (2013)

(Rapid Carbonization)

Example 15

The PBI precursor fiber 1 serving as the second precursor fiber was subjected to rapid carbonization in the following manner. Specifically, the PBI precursor fiber 1 was rapidly heated from room temperature to 1,040° C. for 0.2 seconds in a nitrogen atmosphere using Curie Point Pyrolyzer (available from Japan Analytical Industry Co., Ltd.) and was retained for 5 seconds. Thereby, PBI carbon fibers according to Example 15 were produced.

Example 16

PBI carbon fibers according to Example 16 were produced in the same manner as in the method for producing the PBI carbon fibers according to Example 15 except that the PBI precursor fiber 1 was changed to the PBI precursor fiber 2.

<Confirmation of Structure Using Electron Microscope>

Figure 4A:
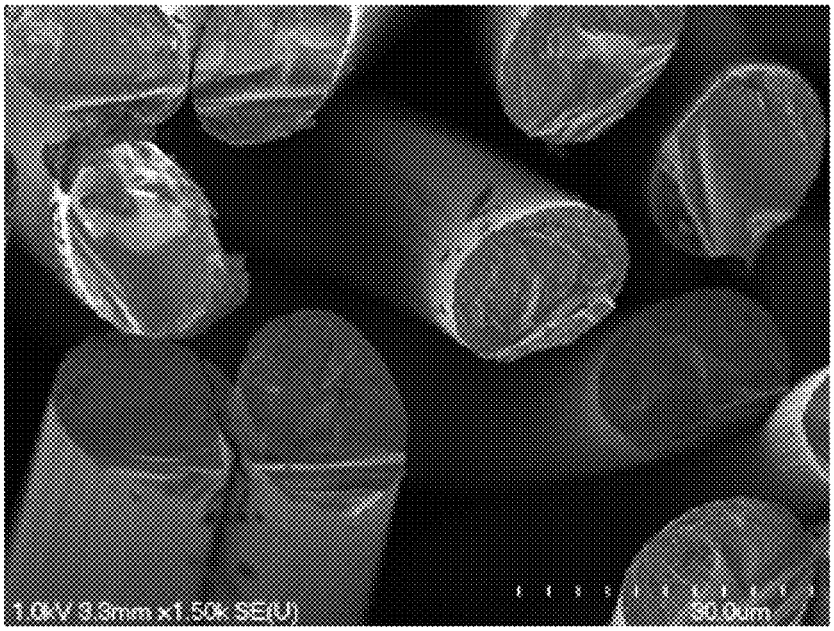
FIG. 4A is an image presenting cross sections of PBI carbon fibers according to Example 15 obtained through an electron microscope.
Figure 4B:
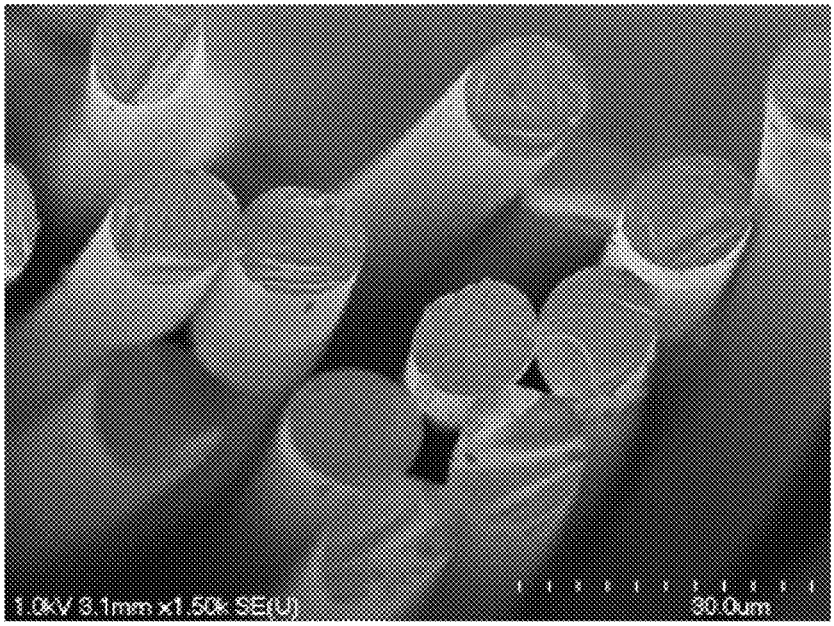
FIG. 4B is an image presenting cross sections of PBI carbon fibers according to Example 16 obtained through an electron microscope.

FIGS. 4A to 4B are images (SEM images) presenting cross sections of the PBI carbon fibers according to Examples 15 and 16, which are obtained through an electron microscope. Here, FIG. 4A is an image presenting cross sections of the PBI carbon fibers according to Example 15 obtained through an electron microscope, and FIG. 4B is an image presenting cross sections of the PBI carbon fibers according to Example 16 obtained through an electron microscope.

As presented in FIGS. 4A and 4B, the PBI carbon fibers according to Examples 15 and 16 each have a cross-sectional shape of nearly perfect circle and are carbon fibers each of which is hardly adhered to another fiber.

(Properties of PBI Carbon Fibers)

The PBI carbon fibers of the present invention were measured for density, crystallinity, and microvoids (pores) in order to verify that properties of the PBI carbon fibers were different from properties of other carbon fibers.

<Measurement of Density>

The PBI carbon fibers according to Examples 1 to 6 and 8 to 13 were each measured for density by a sink-float method. Measurement results of the obtained densities are presented in FIG. 5.

Figure 5:
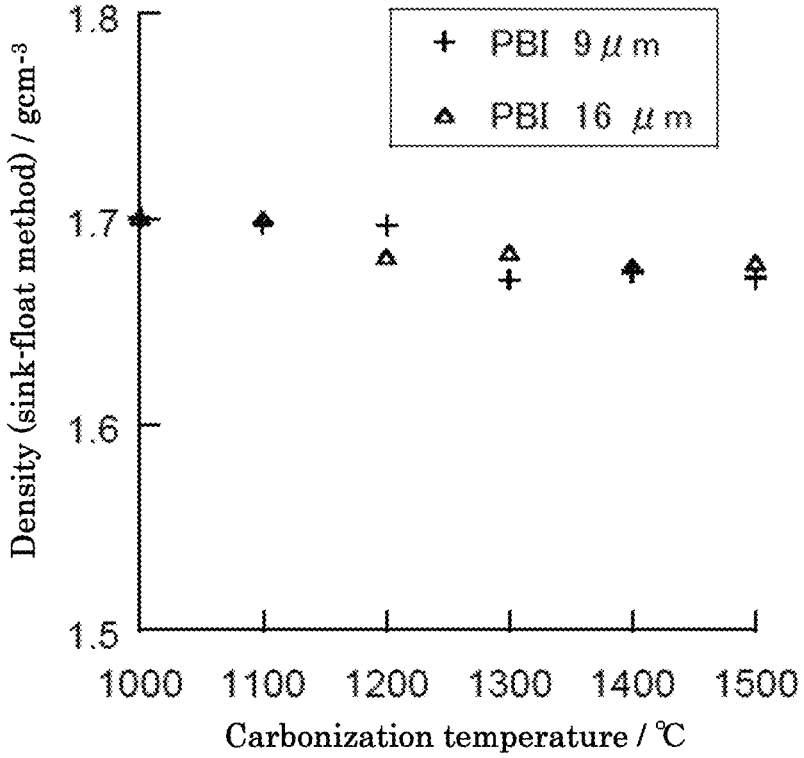
FIG. 5 is a graph presenting measurement results of density.

As presented in this FIG. 5, among the densities of the PBI carbon fibers according to Examples 1 to 6 and 8 to 13, the highest density was about 1.7 g/cm$^3$ at most.

It is found that each of the PBI carbon fibers according to the present invention has a density lower than densities of other carbon fibers because densities of commercially available products of PAN carbon fibers are within a range of from 1.75 g/cm$^3$ to 1.85 g/cm$^3$.

<Measurement of Crystallinity>

Figure 6A:
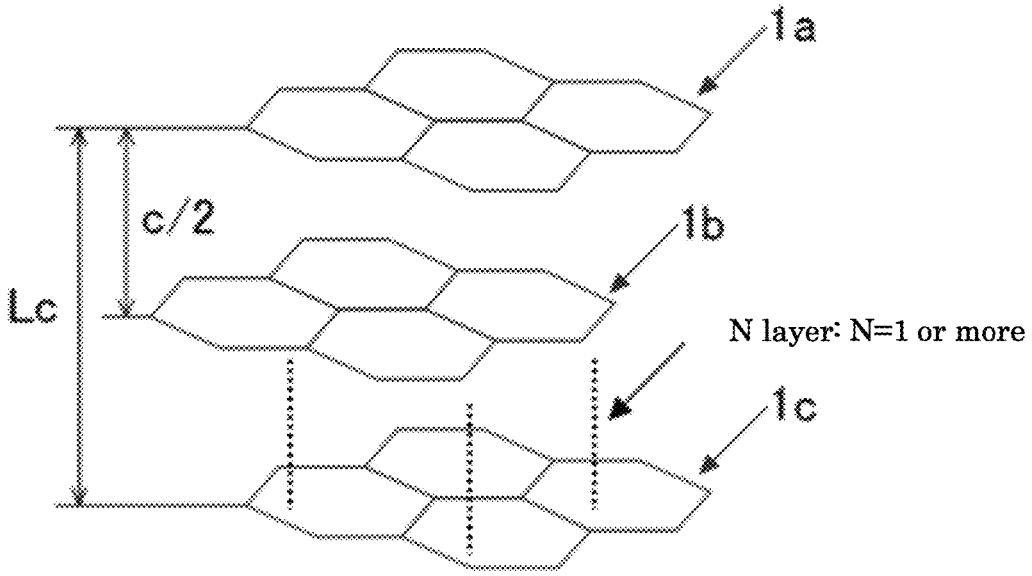
FIG. 6A is a schematic view presenting plane interval c/2 of carbon network planes and stack thickness $L_c$ of carbon network planes in a graphite crystal.

First, plane interval c/2 of carbon network planes and stack thickness $L_c$ of carbon network planes were measured as parameters indicating graphite crystallinity of carbon fibers. FIG. 6A is a schematic view presenting plane interval c/2 of carbon network planes and stack thickness $L_c$ of carbon network planes in a graphite crystal. Note that, reference signs 1*a*, 1*b* and 1*c* in FIG. 6A represent carbon network planes.

Figure 6B:
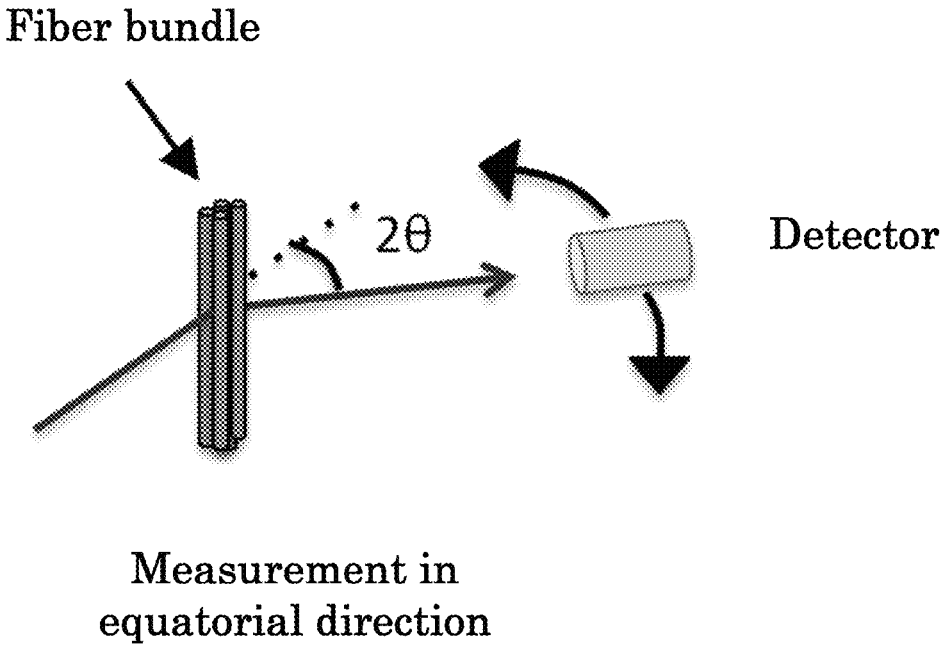
FIG. 6B is a schematic view presenting an optical system in measuring wide angle X-ray diffraction profile.

The measurement of the plane interval c/2 of the carbon network planes and the stack thickness $L_c$ of the carbon network planes was performed by measuring a wide angle X-ray diffraction profile with an X-ray diffraction device using CuKα rays monochromatized with a Ni filter as an X-ray source. Specifically, in the optical system for an equatorial direction illustrated in FIG. 6B, the plane interval c/2 of carbon network planes and the stack thickness $L_c$ of carbon network planes were obtained from the peak of (002) observed at 2θ=26° in the equatorial direction profile. Note that, FIG. 6B is a schematic view indicating an optical system in measuring a wide angle X-ray diffraction profile, where the equatorial direction is a direction in which the detector is perpendicular to the fiber axis.

The plane intervals c/2 and the stack thicknesses Lc of the PBI carbon fibers according to Examples 6 and 13 (carbonization treatment temperature of 1,500° C.) are presented in Table 1 described below.

Moreover, the plane intervals c/2 and the stack thicknesses Lc of the PBI carbon fibers according to Examples 6 and 13, which were obtained through a graphitization treatment under heating at a graphitization temperature of 2,800° C., are also presented in Table 1 described below.

TABLE 1

| | Carbonization•graphitization temperature (° C.) | c/2 (nm) | Lc (nm) |
|---|---|---|---|
| Example 13 (9 μm) | 1,500 | 0.355 | 1.47 |
| Example 6 (16 μm) | 1,500 | 0.352 | 1.56 |
| Example 13 (9 μm) | 2,800 | 0.342 | 9.41 |
| Example 6 (16 μm) | 2,800 | 0.341 | 9.43 |

The plane intervals c/2 and the stack thicknesses Lc of the PBI carbon fibers according to Examples 6 and 13 described in Table 1 were substantially the same values as the plane intervals c/2 and the stack thicknesses Lc of PAN carbon fibers subjected to almost the same carbonization treatment (carbonization treatment of 1,500° C.) as the above, which are described in the below-described Referential Document 2 and Referential Document 3. However, the PBI carbon fibers of the present invention can be distinguished from the pitch carbon fibers because the PBI carbon fibers have wider plane intervals c/2 and smaller stack thicknesses Lc than those of pitch carbon fibers subjected to almost the same carbonization treatment as the above. That is, the PBI carbon fibers according to the present invention have wider plane intervals c/2 and smaller stack thicknesses Lc than those of the pitch carbon fibers.

Figure 7:
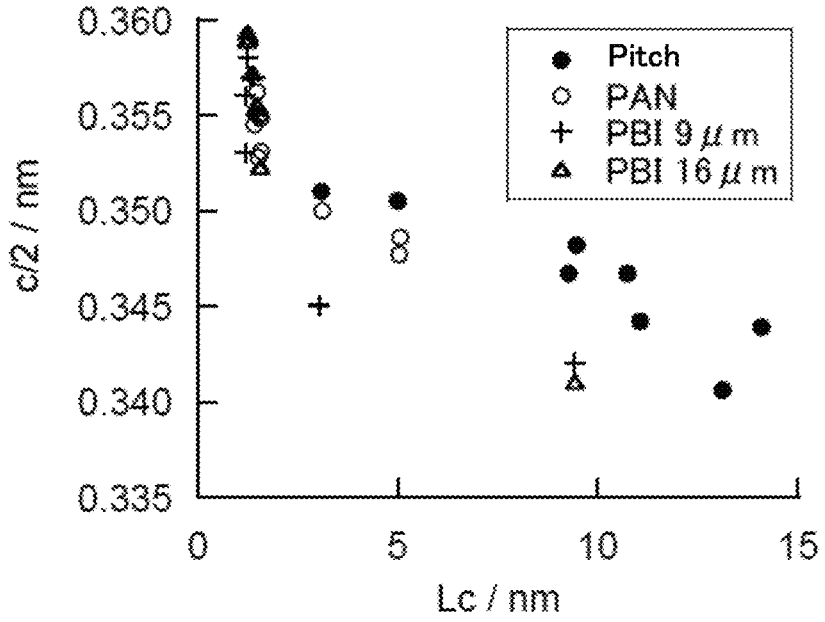
FIG. 7 is a graph presenting a relationship between plane interval c/2 and stack thickness Lc of carbon network planes.

Moreover, as presented in FIG. 7, the plane intervals c/2 and the stack thicknesses Lc of the PBI carbon fibers according to Examples 6 and 13, which were subjected to a graphitization treatment at 2,800° C., have narrower stack thicknesses Lc compared to PAN graphite fibers and pitch graphite fibers, which were subjected to almost the same graphitization treatment as described in the below-described Referential Document 2 and Referential Document 3. Therefore, the PBI carbon fibers can be distinguished from the PAN carbon fibers and the pitch carbon fibers.

Referential Document 2; E. Fitzer, Carbon 27, 5, 621 (1989)

Referential Document 3; A. Takaku, et al., J. Mater. Sci., 25, 4873 (1990)

<Measurement of Microvoids>

As parameters evaluating the carbon fibers for microvoids (pores), volumes and average cross-sectional areas of microvoids in the carbon fibers were measured. The measurement of the volumes and the average cross-sectional areas of the microvoids in the carbon fibers was performed by measuring a small angle X-ray diffraction profile with an X-ray diffraction device using CuKα rays monochromatized with a Ni filter as an X-ray source. Specifically, in the optical system for an equatorial direction illustrated in FIG. 6B, the volumes and the average cross-sectional areas of the microvoids were determined from the scattering patterns observed in the equatorial direction profile of a range of 2θ=0.5° through 8°. Here, the analysis method and the calculation method were performed according to the methods described in the Referential Document 3.

Regarding the volume and the average cross-sectional area of the microvoids, T300 (available from Toray Industries, Inc.) (Referential Example 1) and IMS 60 (available from Toho Tenax Co., Ltd.) (Referential Example 2) as commercially available products of typical PAN carbon fibers were used for comparison.

Figure 8:
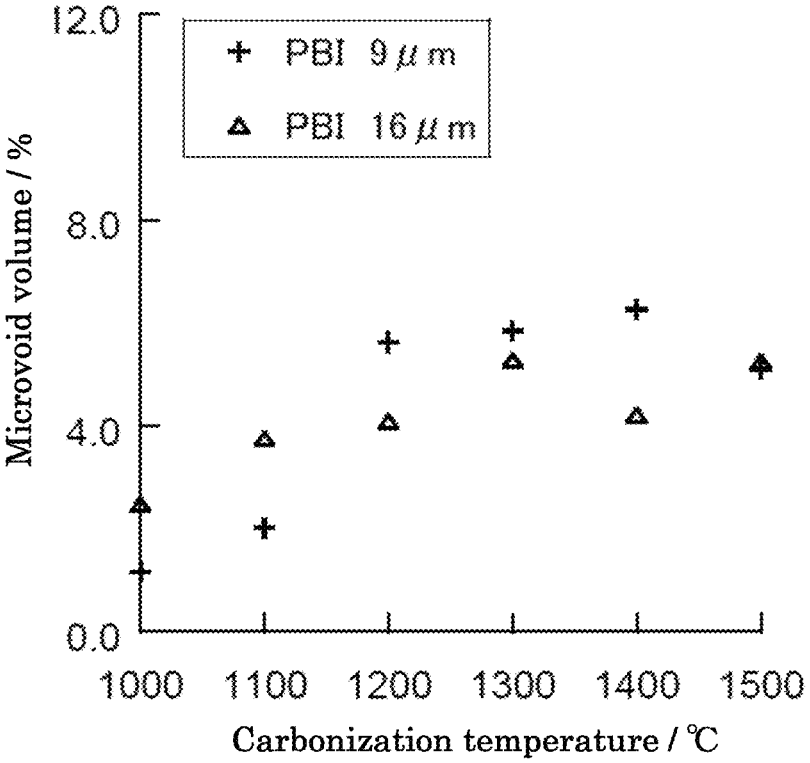
FIG. 8 is a graph presenting measurement results of cross-sectional areas of microvoids.

First, volume percentages of the microvoids of the PBI carbon fibers according to Examples 1 to 6 and 8 to 13 are presented in FIG. 8. As presented in FIG. 8, compared to values of the Referential Example 1 and the Referential Example 2 (Referential Example 1: 4.9%, Referential Example 2: 5.7%), the volumes of the microvoids of the PBI carbon fibers according to Examples 1 to 6 and 8 to 13 are similar to the above values or are lower than the above values, which indicates that occurrence of microvoids causing breakage is low.

Figure 9:
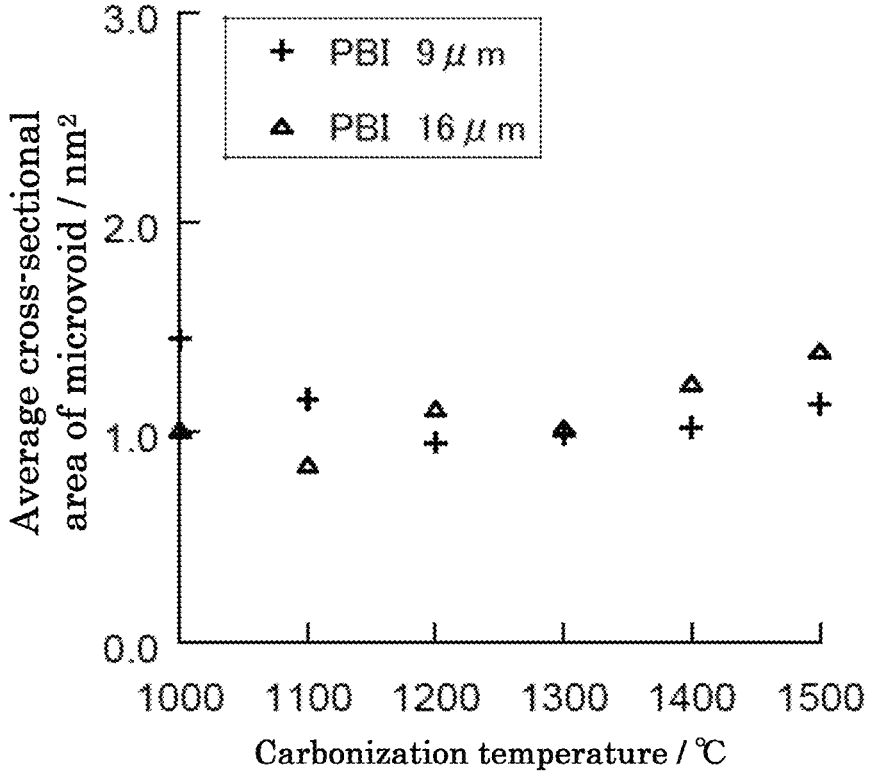
FIG. 9 is a graph presenting measurement results of volume percentages of microvoids.

Next, average cross-sectional areas of the microvoids of the PBI carbon fibers according to Examples 1 to 6 and 8 to 13 are presented in FIG. 9. As presented in FIG. 9, a considerable difference among the average cross-sectional areas of the microvoids of the PBI carbon fibers according to Examples 1 to 6 and 8 to 13 cannot be found. However, the values of the average cross-sectional areas of the microvoids presented in FIG. 9 are considerably low; i.e., about half the values of Referential Example 1 and Referential Example 2 (Referential Example 1: 2.52 nm$^2$, Referential Example 2: 2.11 nm$^2$).

REFERENCE SIGNS LIST

1*a*, 1*b*, 1*c* Carbon network planes
c/2 Plane interval of carbon network planes
$L_c$ Stack thickness of carbon network planes

The invention claimed is:

1. A method for producing a polybenzimidazole carbon fiber, the method comprising:

spinning, in an acid solution, a polymer including polybenzimidazole including a structure represented by General Formula (1) or General Formula (2) below as a structural unit, to thereby obtain a first precursor fiber of the polymer;

contacting the first precursor fiber with a basic solution, and neutralizing the acid solution remaining in the first precursor fiber to be removed, to thereby obtain a second precursor fiber; and heating the second precursor fiber at a temperature of from 1,000° C. to 1,600° C. under an inert gas, to thereby turn the second precursor fiber into a carbon fiber;

wherein an obtained polybenzimidazole carbon fiber has a tensile modulus of 100 GPa or more and a tensile strength of 0.8 GPa or higher; and (1)

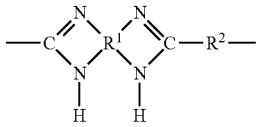

(2)

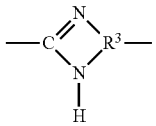

where in the General Formulas (1) and (2), $R^1$ and $R^3$ each represent a trivalent or tetravalent group of one selected from the group consisting of aryl groups and unsaturated heterocyclic groups that are expressed by any one of Structural Formulas (1) to (10) below, and $R^2$ represents a bivalent group of one selected from the group consisting of aryl groups and unsaturated heterocyclic groups that are expressed by any one of the Structural Formulas (1) to (10), alkenylene groups including from 2 to 4 carbon atoms, an oxygen atom, a sulfur atom, and a sulphonyl group:

(1)

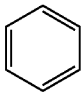

(2)

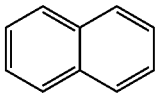

(3)

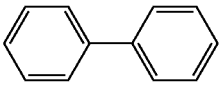

(4)

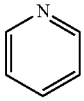

-continued (5)

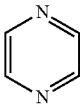

(6)

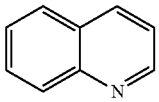

(7)

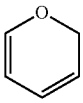

(8)

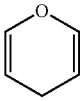

(9)

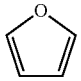

(10)

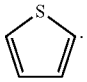

2. The method for producing a polybenzimidazole carbon fiber according to claim 1, wherein the acid solution is polyphosphoric acid and the basic solution is an ethanol solution of triethylamine.

3. The method for producing a polybenzimidazole carbon fiber according to claim 1, wherein the contacting is allowing the first precursor fiber to pass through a bath of the ethanol solution of triethylamine for from 5 seconds to 30 seconds to neutralize the polyphosphoric acid remaining in the first precursor fiber to be removed.

4. The method for producing a polybenzimidazole carbon fiber according to claim 1, wherein the spinning further comprises: coagulating, in a coagulation bath, a reaction solution of the polymer obtained through polymerization in a first acid solution, to thereby obtain a first coagulated matter of the polymer; contacting the first coagulated matter with a first basic solution to neutralize the first acid solution remaining in the first coagulated matter to be removed, to thereby obtain a second coagulated matter; and dissolving the second coagulated matter in a second acid solution to prepare a raw liquid for spinning, and spins the raw liquid for spinning, to thereby obtain a first precursor fiber of the polymer, and wherein the contacting is contacting the first precursor fiber with a second basic solution, and neutralizing the second acid solution remaining in the first precursor fiber to be removed, to thereby obtain a second precursor fiber.

5. The method for producing a polybenzimidazole carbon fiber according to claim 4, wherein the first acid solution is polyphosphoric acid, the first basic solution is an aqueous sodium hydrogen carbonate solution, the second acid solution is methanesulfonic acid, and the second basic solution is an ethanol solution of triethylamine.

6. The method for producing a polybenzimidazole carbon fiber according to claim 4, wherein the contacting is allowing the first precursor fiber to pass through a bath of the ethanol solution of triethylamine for from 5 seconds to 30 seconds, and neutralizing the methanesulfonic acid remaining in the first precursor fiber to be removed.

7. The method for producing a polybenzimidazole carbon fiber according to claim 1, wherein a heating temperature of the heating is a temperature of from 1,200° C. to 1,400° C.

8. The method for producing a polybenzimidazole carbon fiber according to claim 1, wherein the obtained polybenzimidazole carbon fiber is a continuous fiber with a fiber diameter of 8 μm or greater but 30 μm or less.

* * * * *